US006594627B1

(12) United States Patent
Goyal et al.

(10) Patent No.: US 6,594,627 B1
(45) Date of Patent: Jul. 15, 2003

(54) METHODS AND APPARATUS FOR LATTICE-STRUCTURED MULTIPLE DESCRIPTION VECTOR QUANTIZATION CODING

(75) Inventors: Vivek K. Goyal, Hoboken, NJ (US); Jonathan Adam Kelner, Old Westbury, NY (US); Jelena Kovacevic, New York, NY (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/533,232

(22) Filed: Mar. 23, 2000

(51) Int. Cl.[7] ..... G10L 19/12
(52) U.S. Cl. ..... 704/222; 704/222; 704/221
(58) Field of Search ..... 704/222, 500, 704/229, 247; 382/251

(56) References Cited

U.S. PATENT DOCUMENTS 5,649,030 A * 7/1997 Normile et al. ..... 348/417.1

OTHER PUBLICATIONS

Fleming, et al., "Generalized Multiple Description Vector Quantization," Data Compression Conference, IEEE Computer Society Mar. 29–31, 1999, p. 3–12.*

Gersho, et al., "Vector Quantization and Signal Compression," Kluwer Academic Publishers, 1992, p. 187–188.*

Ozarow, L., "On a Source–Coding Problem with Two Channels and Three Receivers," The Bell System Technical Journal, vol. 59, No. 10, Dec. 1980.*

Vaishampayan, V., "Vector Quantizer Design for Diversity Systems," Proc. Twenty–Fifth Ann. Conf. Information Sci. Syst., Johns Hopkins University, Mar. 20–22, 1991, p. 564–569.*

Vaishampayan, V. et al., "Multiple–Description Vector Quanitzation with Lattice Codebooks: Design and Analysis," IEEE Transactions on Information Theory, vol. 47, No. 5, Jul. 2001.*

V.A. Vaishampayan, "Design of Multiple Description Scalar Quantizers," IEEE Transactions on Information Theory, vol. 39, No. 3, pp. 821–834, May 1993.

S.D. Servetto et al., "Multiple Description Lattice Vector Quantization," Proc. IEEE Data Compression Conf., pp. 13–22, Snowbird, Utah, Apr. 1999.

* cited by examiner

*Primary Examiner*—Marsha D. Banks-Harold
*Assistant Examiner*—V. Paul Harper

(57) ABSTRACT

A lattice-structured multiple description vector quantization (LSMDVQ) encoder generates M descriptions of a signal to be encoded, each of the descriptions being transmittable over a corresponding one of M channels. The encoder is configured based at least in part on a distortion measure which is a function of a central distortion and at least one side distortion. For example, if M=2, the distortion measure may be an average mean-squared error (AMSE) function of the form $f(D_0, D_1, D_2)$, where $D_0$ is a central distortion resulting from reconstruction based on receipt of both a first and a second description, and $D_1$ and $D_2$ are side distortions resulting from reconstruction using only a first description and a second description, respectively. Further performance improvements may be obtained through perturbation of the lattice points. The LSMDVQ techniques of the invention can also be extended to cases of M greater than two, for which the encoder may utilize an ordered set of M codebooks $\Lambda_1, \Lambda_2, \ldots, \Lambda_M$ of increasing size, with the coarsest codebook corresponding to a lattice. In such cases, for each number k of descriptions received, there may be a single decoding function that maps the received vector to a corresponding one of the codebooks $\Lambda_k$, such that reconstruction of the signal requires no more than M such decoding functions.

15 Claims, 6 Drawing Sheets

(a)

(b)

(a)

(b)

METHODS AND APPARATUS FOR LATTICE-STRUCTURED MULTIPLE DESCRIPTION VECTOR QUANTIZATION CODING

FIELD OF THE INVENTION

The present invention relates generally to multiple description (MD) coding of data, speech, audio, images, video and other types of signals, and more particularly to MD coding which utilizes lattice vector quantization.

BACKGROUND OF THE INVENTION

Multiple description (MD) coding is a source coding technique in which multiple bit streams are used to describe a given source signal. Each of these bit streams represents a different description of the signal, and the bit streams can be decoded separately or in any combination. Each bit stream may be viewed as corresponding to a different transmission channel subject to different loss probabilities. The goal of MD coding is generally to provide a signal reconstruction quality that improves as the number of received descriptions increases, without introducing excessive redundancy between the descriptions.

By way of example, two-description MD coding is characterized by two descriptions having rates $R_1$ and $R_2$ and corresponding single-description reconstruction distortions $D_1$ and $D_2$, respectively. The single-description distortions $D_1$ and $D_2$ are also referred to as side distortions. The distortion resulting from reconstruction of the original signal from both of the descriptions is designated $D_0$ and referred to as the central distortion. Similarly, the corresponding single-description and two-description decoders are called side and central decoders, respectively. A balanced two-description MD coding technique refers to a technique in which the rates $R_1$ and $R_2$ are equal and the expected values of the side distortions $D_1$ and $D_2$ are equal.

A well-known MD coding approach known as MD scalar quantization (MDSQ) is described in V. A. Vaishampayan, "Design of multiple description scalar quantizers," IEEE Transactions on Information Theory, Vol. 39, No. 3, pp. 821–834, May 1993. In an example of two-description MDSQ, a real number $x\epsilon\mathbb{R}$ is quantized using two different scalar quantizers, and each quantizer output transmitted on a corresponding one of two different channels. If either channel is received by itself, the original number x is known within a given quantization cell of that channel. If both channels are received, the original value is known within the intersection of its quantization cell in one channel and its quantization cell in the other. In this manner, an MDSQ system provides coarse information to side decoders and finer information to a central decoder.

An MDSQ system may alternatively be viewed as a partition of a real line along with an injective mapping between partition cells and ordered pairs of indices, i.e., discrete sets of indices $I_1$ and $I_2$ and a map $l:\mathbb{R}\rightarrow I_1\times I_2$. A partition cell is then given by the set $\{x\epsilon\mathbb{R}|l(x)=(i,j)\}$ for a given $i\epsilon I_1$, $j\epsilon I_2$. The individual scalar quantizers are given by the induced projected mappings $l_1=\pi_1(l):\mathbb{R}\rightarrow I_1$ and $l_2=\pi_2(l):\mathbb{R}\rightarrow I_2$.

However, just as it is possible to construct single description vector quantizers that improve upon the performance of scalar quantizers, it is also possible to construct multiple description vector quantizers that out perform their scalar counterparts. In vector quantization, a given data value to be transmitted is represented as a point in a space of two or more dimensions.

Like the above-described MDSQ approach, multiple description vector quantization (MDVQ) may be viewed as discrete sets of indices $I_1$ and $I_2$ along with a map $l:\mathbb{R}^n\rightarrow I_1\times I_2$ (which induces the projected mappings $I_1=\pi_1(l):\mathbb{R}^n\rightarrow I_1$ and $I_2=\pi_2(l):\mathbb{R}^n\rightarrow I_2$). The partition cells given by $\{x\epsilon\mathbb{R}^n|l(x)=(i,j)\}$ for a given $i\epsilon I_1, j\epsilon I_2$. These cells are typically designed to be so-called Voronoi cells of some collection of points. A Voronoi cell is more generally referred to herein as a unit cell.

Although superior in performance to its scalar counterpart, general vector quantization is computationally expensive. However, significant reductions in computational complexity can be attained by organizing the data points into two or more lattices that intersect or are related as lattice and sublattice. More particularly, restricting MDVQ codebooks to lattices simplifies the necessary calculations for encoding and decoding. The problem then becomes that of choosing a lattice and designing a way of assigning the indices. The resulting coding techniques are referred to as multiple description lattice vector quantization (MDLVQ) techniques. An example of a coding technique of this type is described in S. D. Servetto, V. A. Vaishampayan, and Sloane, "Multiple description lattice vector quantization," Proc. IEEE Data Compression Conf., pp. 13–22, Snowbird, Utah, April 1999, which is incorporated by reference herein. This algorithm is also referred to herein as the SVS algorithm.

Although the SVS algorithm facilitates the implementation of MDLVQ encoding, thereby allowing performance improvements relative to MDSQ encoding, this approach has a number of significant drawbacks. For example, the SVS algorithm is inherently optimized for the central decoder, i.e., for a zero probability of a lost description. In other words, an SVS encoder is designed to minimize the central distortion $D_0$, Since MD techniques are generally only useful when both descriptions are not always received, this type of minimization is inappropriate and does not lead to optimal performance. In addition, the SVS algorithm and other known MDLVQ approaches are unduly inflexible as to the structure of the lattices. Another drawback is that there is no known technique for extending the known MDLVQ approaches to applications involving more than two descriptions.

SUMMARY OF THE INVENTION

The present invention provides improved coding techniques referred to herein as lattice-structured multiple description vector quantization (LSMDVQ) techniques.

In accordance with a first aspect of the invention, one or more lattices are configured in a manner that tends to minimize the distortion-rate performance of the system, i.e., the expected performance for a given distortion rate. An LSMDVQ encoder generates M descriptions of a signal to be encoded, each of the descriptions being transmittable over a corresponding one of M channels. The encoder in an illustrative embodiment utilizes one or more lattices configured to minimize a distortion measure which is a function of a central distortion and at least one side distortion. For example, if M=2, the distortion measure may be an average mean-squared error (AMSE) function of the form $f(D_0, D_1, D_2)$, where $D_0$ is a central distortion resulting from reconstruction based on receipt of both a first and a second description, and $D_1$ and $D_2$ are side distortions resulting from reconstruction using only a first description and a second description, respectively. In the illustrative embodiment, the above-noted distortion measure is used as the basis for a distance metric used to characterize the distance between lattice points, and a unit cell of the lattice is defined in terms of the distance metric.

In accordance with another aspect of the invention, a lattice is perturbed in order to provide further performance improvements. For example, the encoder may utilize a lattice in which the locations of the lattice points other than the points in at least one designated sublattice have been perturbed relative to a regular lattice structure based at least in part on a grouping of points into equivalence classes, with the position of a subset of the points in a given class being adjusted as part of the lattice perturbation.

Although illustrated herein using lattices, the present invention can be more generally applied to ordered sets of codebooks, e.g., an ordered set of codebooks of increasing size in which only the coarsest of the codebooks corresponds to a lattice.

In accordance with a further aspect of the invention, an extension of LSMDVQ to more than two descriptions is provided. The encoder utilizes an ordered set of M codebooks $\Lambda_1, \Lambda_2, \ldots, \Lambda_M$ of increasing size, with the coarsest codebook corresponding to a lattice. In such cases, for each number k of descriptions received, there is single decoding function that maps the received vector to a corresponding one of the codebooks $\Lambda_k$, such that reconstruction of the signal requires no more than M such decoding functions.

The LSMDVQ techniques of the invention are suitable for use in conjunction with signal transmission over many different types of channels, including lossy packet networks such as the Internet as well as broadband ATM networks, and may be used with data, speech, audio, images, video and other types of signals.

BRIEF DESCRIPTION OF THE DRAWINGS

FIG. 4(*b*) shows an optimal index assignment for an example index-7 sublattice.

DETAILED DESCRIPTION OF THE INVENTION

Figure 1:
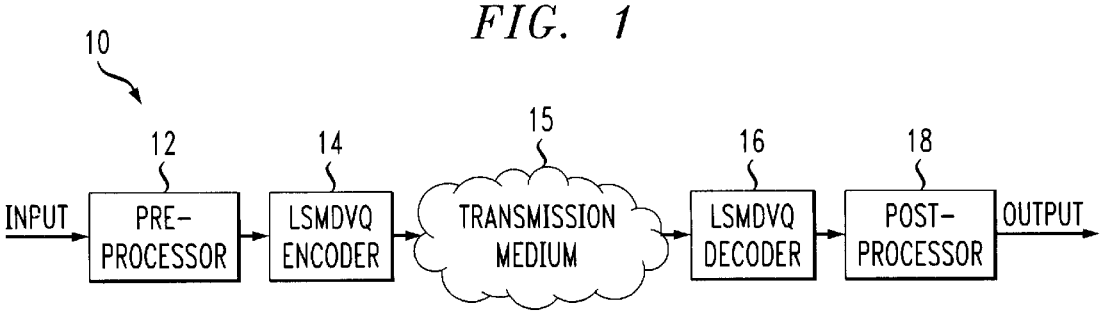
FIG. 1 shows an exemplary communication system in accordance with the invention.

The invention will be illustrated below in conjunction with exemplary MD coding systems. The techniques described may be applied to transmission of a wide variety of different types of signals, including data signals, speech signals, audio signals, image signals, and video signals, in either compressed or uncompressed formats. The term "channel" as used herein refers generally to any type of communication medium for conveying a portion of a encoded signal, and is intended to include a packet or a group of packets. The term "packet" is intended to include any portion of an encoded signal suitable for transmission as a unit over a network or other type of communication medium. The term "vector" as used herein is intended to include any grouping of coefficients or other components representative of at least a portion of a signal.

The present invention provides lattice-structured multiple description vector quantization (LSMDVQ) coding techniques which exhibit improved performance relative to conventional techniques such as the previously-noted SVS algorithm. However, in order to illustrate more clearly the performance advantages of the invention, the conventional two-description SVS algorithm will first be described in greater detail.

In the following description, $\Lambda$ will denote a lattice. $\Lambda'$ is a geometrically similar sublattice of $\Lambda$ if the points of $\Lambda'$ are a subset of the points of $\Lambda$, and $\Lambda'=cA\Lambda$ for some scalar c and some orthogonal matrix A with determinant 1. Thus, a geometrically similar sublattice is a sublattice obtained by scaling and rotating the original lattice.

The SVS algorithm finds a triplet $(\Lambda, \Lambda', l)$ such that:

1. $\Lambda$ is a lattice;
2. $\Lambda'$ is a geometrically similar sublattice of $\Lambda$; and
3. $l: \Lambda \xrightarrow{inj.} \Lambda' \times \Lambda'$.

The index of the sublattice $N=|\Lambda/\Lambda'|$ controls the redundancy of the system, i.e., a higher index results in a lower redundancy.

Every point in the lattice is labeled with a pair of points on the similar sublattice. Encoding is then performed using the Voronoi cells of the lattice points. More particularly, a given point is encoded to $\lambda\epsilon\Lambda$, and then $\pi_1(l(\lambda))\epsilon\Lambda'$ is transmitted over one channel and $\pi_2(l(\lambda))\epsilon\Lambda'$ is transmitted over the other. If one channel is received, one can decode to the sublattice. If both channels are received, one can decode to the lattice itself. This approach thus provides coarse information if only one channel is received successfully and finer information if both channels are received successfully. In accordance with the conventional SVS algorithm, the map l is determined as follows:

1. Choose a lattice $\Lambda$, a geometrically similar $\Lambda'$ of index N, and a group W of rotations of the lattice that map back to the lattice.
2. Define $\equiv$ such that $\lambda_1 \equiv \lambda_2$ if and only if there exists $\tau\epsilon W$ such that $\lambda_1-\pi_{\Lambda'}(\lambda_1)=\tau(\lambda_2-\pi_{\Lambda'}(\lambda_2))$, where $\pi_{\Lambda'}$ maps a point to its nearest sublattice neighbor. Points are equivalent under this relation if and only if they are in the same orbit of W relative to their nearest sublattice neighbors.
3. Define $E\subseteq\Lambda'\times\Lambda'$ by $$E=\{(\lambda'_1,\lambda'_2)\epsilon\Lambda'\times\Lambda':\|\lambda'_1-\lambda'_2\|\leqq\|c\lambda A\|\},$$

where $\Lambda'=cA\Lambda$ and $\lambda\epsilon\Lambda'$ is a lattice point of maximal norm in the Voronoi cell of $0\epsilon\Lambda'$, and the elements of E are referred to as edges. In other words, a valid label $(\lambda'_1, \lambda'_2)$, i.e., an edge, for a point $\lambda$ on the original lattice must consist of sublattice points at a certain, bounded distance from each other. This ensures that a given data point is not encoded with sublattice points too far away from it so as to produce an excessive side distortion.

4. Define ≡' such that $e_1 \equiv' e_2$ with $e_1, e_2 \in E$ if and only if they both serve as minimal vectors in the same similar sublattice of Λ.
5. Color the edges in E using two colors, such that the colors alternate along any straight line of adjacent edges. This step is not strictly necessary, e.g., one can randomly assign colors. However, it is in the SVS algorithm and so is included here for completeness. This step breaks the tie in assigning, e.g., which point would get (a, b) versus (b, a).
6. For each equivalence class of ≡, select an equivalence class of ≡' to be matched with it. As there will be several ways of choosing this matching, perform a numerical optimization over the different choices to select the one that yields the optimal results. This is typically the most important step in that it results in an optimal index assignment l. More specifically, it determines which orbit of points identified in Step 2 gets associated with which class of edges identified in Step 4.
7. Using the group and the sublattice, extend the matching of equivalence classes to the entire lattice. Use the coloring from Step 5 to determine the order of the points in the sublattice pairs, i.e., which sublattice point gets transmitted over which channel.

Conventional MDLVQ encoding such as the SVS algorithm described above allows significant performance improvements relative to MDSQ encoding. However, as implemented in the SVS algorithm, MDLVQ encoding has unnecessary and unfortunate structural limitations that reduce its usefulness. For example, it uses nested lattices $\Lambda' \subseteq \Lambda$ and begins the encoding process by finding the nearest point in Λ.

The present inventors have determined that the complexity advantage of using lattices can be largely obtained in a more general case where only Λ' is a lattice and the initial step in encoding is to find the nearest point in Λ'. As will become apparent, this allows more flexibility in encoding and tends to provide improved performance.

More specifically, the LSMDVQ coding techniques of the present invention exhibit substantially improved performance relative to the above-described conventional SVS algorithm, while also maintaining the desirable encoding and decoding complexity properties generally associated with MDLVQ coding.

FIG. 1 shows a communication system 10 configured in accordance with an illustrative embodiment of the invention. A discrete-time input signal is applied to a pre-processor 12. The discrete-time signal may represent, for example, a data signal, a speech signal, an audio signal, an image signal or a video signal, as well as various combinations of these and other types of signals. The operations performed by the pre-processor 12 will generally vary depending upon the application.

The output of the pre-processor 12 is a source sequence which is applied to an LSMDVQ encoder 14 in accordance with the present invention. The encoder 14 encodes n different components of the source sequence for transmission over m channels, using lattice vector quantization and entropy coding operations to be described in greater detail below. Each of the m channels may represent, for example, a packet or a group of packets. The m channels are passed through a network 15 or other suitable transmission medium to an LSMDVQ decoder 16. The decoder 16 reconstructs the original source sequence from the received channels. The LSMDVQ coding implemented in encoder 14 operates to ensure optimal reconstruction of the source sequence in the event that one or more of the m channels are lost in transmission through the medium 15. The output of the LSMDVQ decoder 16 is further processed in a post-processor 18 in order to generate a reconstructed version of the original discrete-time signal.

Figure 2:
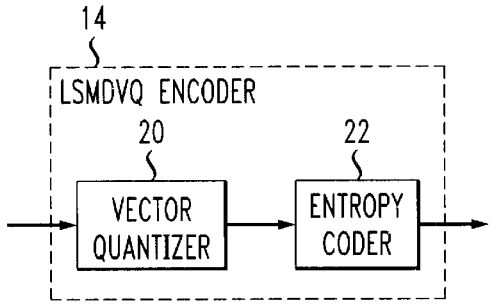
FIG. 2 is a functional block diagram of an LSMDVQ encoder in accordance with the invention.

FIG. 2 illustrates the LSMDVQ encoder 14 in greater detail. The encoder 14 includes a vector quantizer 20 and a vector entropy encoder 22. It should be noted that a complementary decoder structure corresponding to the encoder structure of FIG. 2 may be implemented in the LSMDVQ decoder 16 of FIG. 1.

Figure 3:
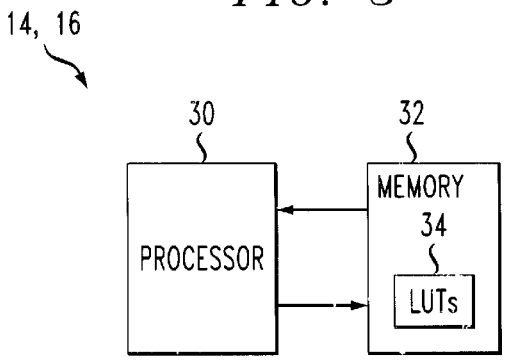
FIG. 3 shows a hardware block diagram of an LSMDVQ encoder or decoder in accordance with the invention.

FIG. 3 illustrates one possible hardware implementation of the encoder 14. This implementation includes a processor 30 and a memory 32. The memory 32 includes one or more lookup tables (LUTs) 34 which store codebooks for use in implementing the vector entropy coding operations described herein. The same or similar hardware elements may be used to implement the decoder 16. The processor 30 may represent a microprocessor, microcontroller, application-specific integrated circuit (ASIC), as well as portions or combinations of these and other devices. The memory 34 may represent, e.g., an electronic memory contained within or otherwise associated with processor 30 or another suitable type of storage device.

It should be understood that the arrangements shown in FIGS. 1 to 3 are by way of example only. The LSMDVQ coding techniques of the invention may be implemented in many other arrangements, as will be apparent to those skilled in the art.

The conventional SVS algorithm as described above uses the Voronoi cells of the original lattice, i.e., the fine resolution or base lattice. Since the decoding is to the resolution of the fine lattice only when both descriptions are received, this is inherently an optimization for the central decoder at the expense of the side decoders. The present invention recognizes that MD coding is useless unless the side decoders are sometimes used, and that it is therefore possible to improve on the SVS approach.

In accordance with an illustrative embodiment of the invention, the criterion of interest in the LSMDVQ coding process is a function of the central and side distortions, i.e., $f(D_0, D_1, D_2)$, and the coding process is configured to explicitly minimize this quantity. In contrast, and as previously noted, the SVS approach inherently minimizes a quantity based on only the central distortion $D_0$. The illustrative embodiment will therefore use as a performance criterion a measure of average distortion conditioned on receiving at least one description. It should be noted that similar results will generally be obtained with other types of performance criteria.

An example of the measure of average distortion conditioned on receiving at least one description is as follows. Assume that the descriptions are lost independently with probability ρ. Omitting the case of receiving neither description and normalizing properly gives $$AMSE = \frac{1-\rho}{1+\rho} D_0 + \frac{\rho}{1+\rho}(D_1 + D_2). \tag{1}$$

where AMSE refers to an average of mean-squared error (MSE) distortions.

After the choice of a lattice and a sublattice, the original SVS algorithm as described above provides a $(D_0, D_1)$ operating point by optimizing the index assignment. The above-cited S. D. Servetto et al. reference provides several such points for a two-dimensional hexagonal lattice with sublattice indices ranging from 7 to 127. The source is uniformly distributed over a region much larger than the Voronoi cells of the lattice.

Figure 4:
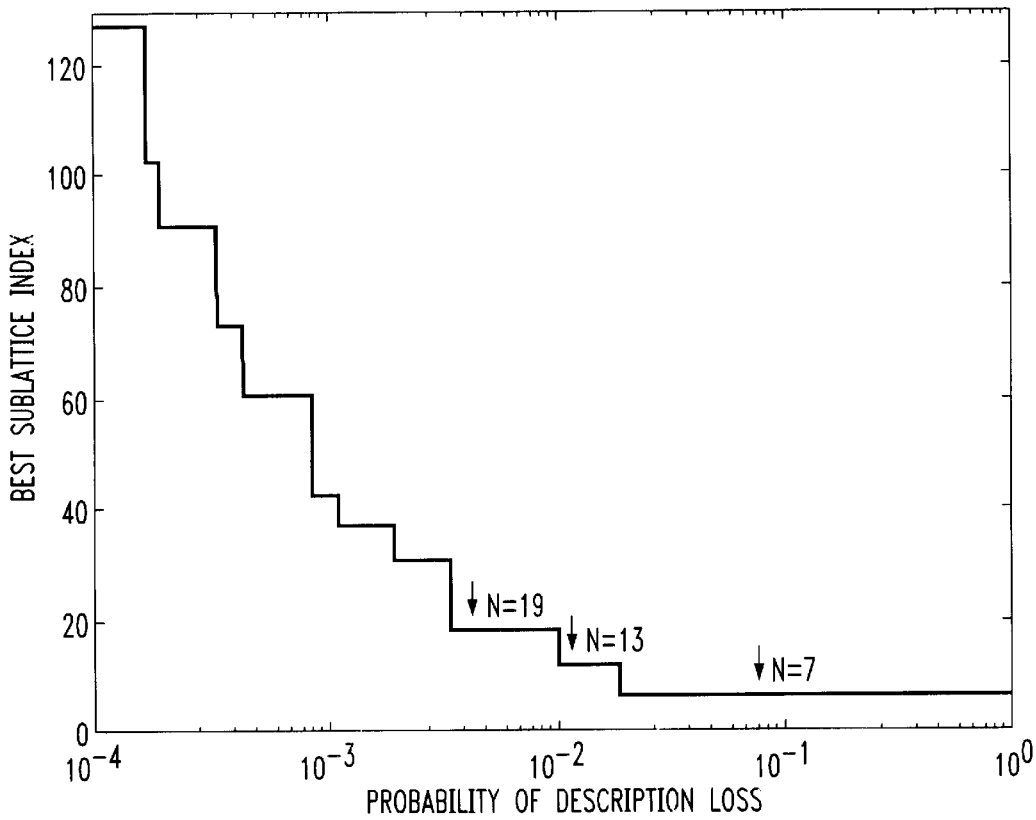
FIG. 4(*a*) shows a plot of sublattice index that minimizes average mean squared error (AMSE) as a function of probability of description loss in accordance with the invention.
Figure 4:
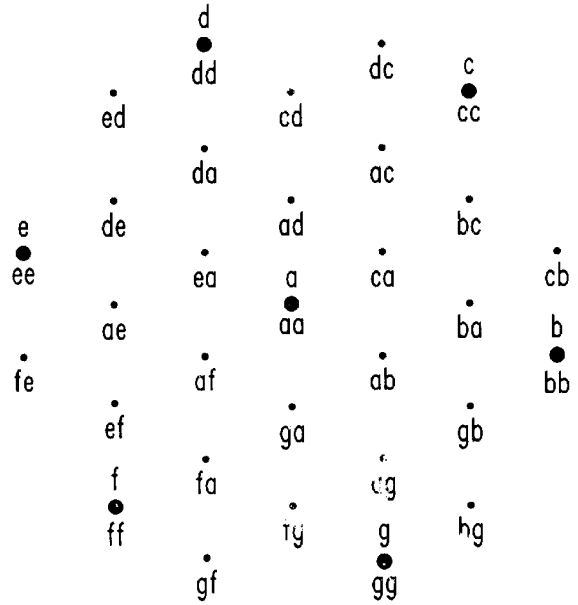

In accordance with the invention, these data can be used to compute the optimal index as a function of the loss parameter p, as shown in FIG. 4(*a*). FIG. 4(*a*) shows the sublattice index that minimizes the AMSE criterion (1) as a function of the loss parameter p for the two-dimensional hexagonal lattice. Index 7 is optimal for p>0.0185. It should be noted that only the data from the above-cited S. D. Servetto et al. reference is used in this example, so the index is optimal from among the index set used there. When limited to the original SVS encoding, for sufficiently large p it becomes optimal to simply repeat the data over both channels.

FIG. 4(*b*) shows the optimal index assignment for the index-7 sublattice. Doublet labels, e.g., aa, db, cd, etc., are the transmitted indices and singlet labels, e.g., a, b, c, etc., are the names of the sublattice points. This example will be used as the basis for other examples below.

To minimize the AMSE (1), the encoder should use Voronoi cells with respect to a corresponding distance measure. The following description will utilize the following three definitions:

1. For $a \in \Lambda$ and $l(a)=(x, y)$, where $x, y \in \Lambda'$, let $\pi_1(a)=x$ and $\pi_2(a)=y$.
2. For $x \in \mathbb{R}$ and $a \in \Lambda$, let the multiple description distance between x and a at loss parameter p be $$d_p(x, a) = \sqrt{\frac{1-p}{1+p}\|x-a\|^2 + \frac{p}{1+p}(\|x-\pi_1(a)\|^2 + \|x-\pi_2(a)\|^2)}\,. \tag{2}$$

3. The Voronoi cell with respect to multiple description distance of an element $a \in \Lambda$ with loss parameter p is $$V_p(a)=\{x \in \mathbb{R}^n : d_p(x,a) \leq d_p(x,b),\ \forall b \in \Lambda\}.$$

Encoding using Voronoi cells with respect to multiple description distance gives a family of encoders parameterized by p. It should be noted that the loss parameter p may, but need not, be equal to the loss probability ρ. If they are equal, it follows immediately from the above definitions that partitioning with Voronoi cells with respect to multiple description distance minimizes the AMSE.

Figure 5:
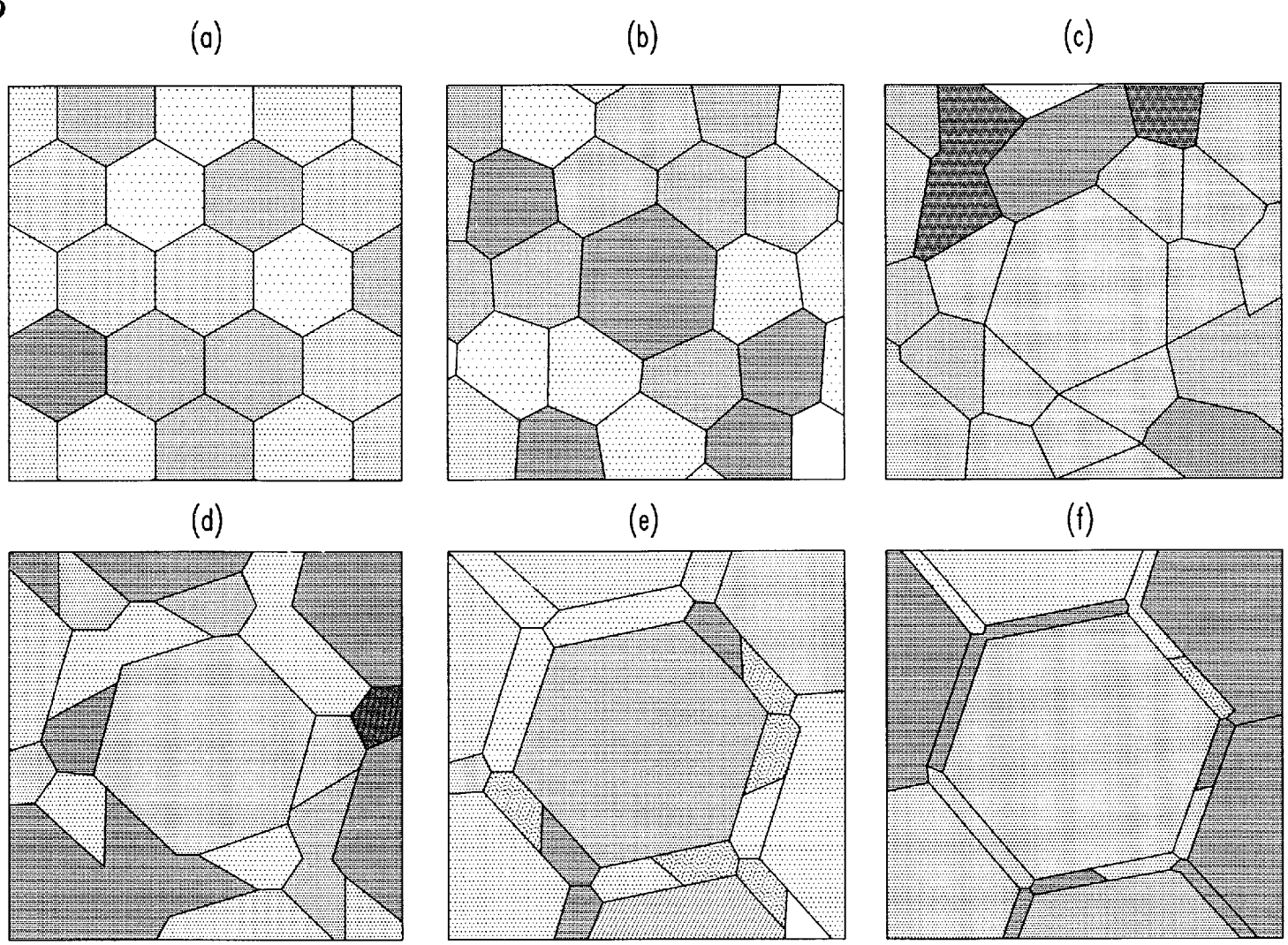
FIGS. 5(*a*) through 5(*f*) show the shapes of Voronoi cells with respect to multiple description distance for different loss parameters.

In order to test this encoding technique of the present invention and determine the magnitude of the improvements, calculations were made using the lattice and sublattice shown in FIG. 4(*b*). The new Voronoi cells for several values of the loss parameter p, i.e., the values 0.0, 0.1, 0.2, 0.4, 0.6 and 0.8, are shown in FIGS. 5(*a*) through 5(*f*), respectively. Note how the shapes of the cells change as p increases. When p is zero, the new Voronoi cells are exactly the same as the standard Voronoi cells of Λ, since a data point will be decoded to the corresponding point on the fine lattice with probability 1.

As p increases, certain "central" cells emerge that are larger than the others. These are the cells of points on the sublattice Λ'. Encoding to points on Λ' is preferred because these points are decoded without error, even at the side decoders. The other cells belong to points of Λ\Λ', where "\" denotes set subtraction. The index assignment 1 maps these other points to ordered pairs of two distinct sublattice points, a closer one and a farther one. As p increases, the large side distortion associated with the farther sublattice point makes encoding to this point unattractive. This effect continues to get more pronounced until the side cells disappear at p=1.

Figure 6:
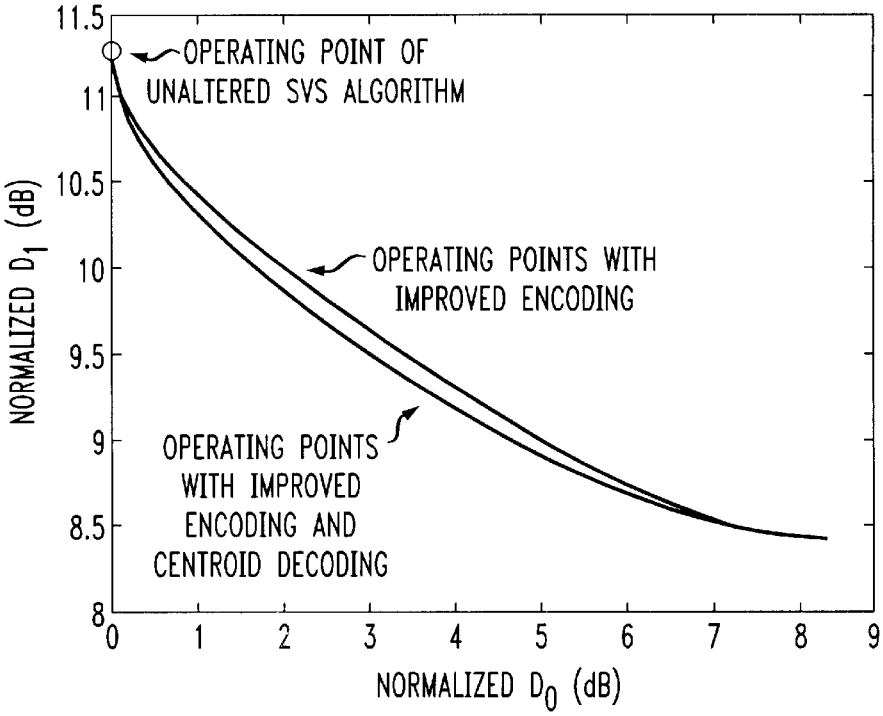
FIGS. 6(*a*) and 6(*b*) show plots comparing central and side distortion operating points for the conventional SVS algorithm and LSMDVQ coding in accordance with the invention.
Figure 6:
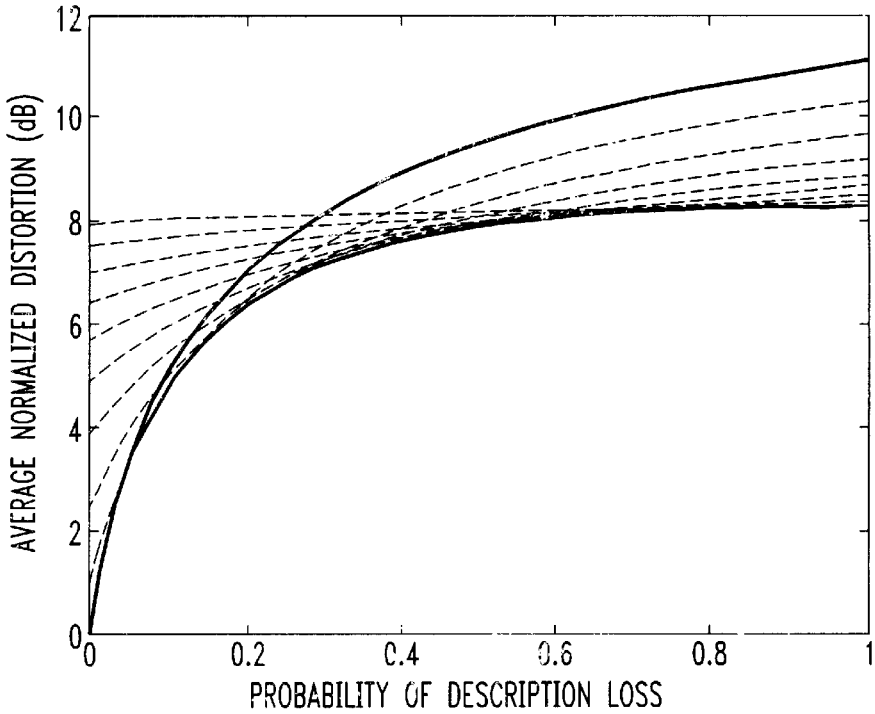

FIG. 6(*a*) shows the operating point of the conventional SVS algorithm with the index-7 sublattice of the hexagonal lattice along with the ranges of operating points obtained with the improved LSMDVQ coding of the present invention. Encoding with the new Voronoi cells gives a set of($D_0$, $D_1$) operating points indexed by p. These are shown by the top curve in FIG. 6(*a*). The leftmost point, circled in the plot, is the sole operating point of the conventional SVS algorithm. The LSMDVQ coding of the illustrative embodiment gives a range of operating points. All the reported distortions are normalized such that $D_0$ with the original SVS encoding is 0 dB. The lower curve in FIG. 6(*a*) shows the improvement obtained by using centroid reconstruction in accordance with the present invention as opposed to reconstructing to the original lattice points as in the SVS algorithm.

From a given ($D_0$, $D_1$) operating point, one can compute AMSE as a function of the loss probability. FIG. 6(*b*) shows a variety of such performance profiles, i.e., multiple plots of AMSE as a function of the loss probability for different values of the loss parameter p. The top solid curve in FIG. 6(*b*) corresponds to the conventional SVS algorithm or, equivalently, loss parameter p=0. The dotted curves are, from steepest to flattest, for p=0.1, 0.2, . . . , 0.9. The best performance, corresponding to the lower solid curve, is obtained when the probability of description loss equals the design parameter p. An additional improvement of up to 0.1 dB, peaking at p≈0.28, is obtained by using centroid reconstruction.

The improvement in dB over the conventional SVS algorithm increases approximately linearly with the probability of description loss, leading to large improvements at high probabilities. It should be noted that the performance improvements of this LSMDVQ coding technique are obtained with virtually no significant increase in computational complexity.

As is apparent from the above, the present invention in the illustrative embodiment is capable of providing additional ($D_0$, $D_1$) operating points in an efficient manner. The merit of these new operating points has been established through the AMSE measure, a weighted average of central and side distortions. It can also be shown that the techniques of the invention improve the lower convex hull of ($D_0$, $D_1$) points.

In accordance with another aspect of the invention, a lattice can be perturbed in order to provide further performance improvements. The manner in which the lattice is perturbed in the illustrative embodiment of the invention will now be described. The elongated shapes of the cells associated with Λ\Λ', along with the fact that these cells do not even contain the corresponding central decoder points at large p, suggest that locations of the points can be modified, i.e., perturbed, to improve the performance of the system.

In perturbing the lattice, it is generally desirable to retain a highly structured set of points. Failure to do so may result in the algorithmic complexity of the encoding process becoming prohibitively large. Thus, the sublattice points are left in their original locations. Next, the equivalence relation ≡ as defined in the SVS algorithm is used to partition the remaining points into equivalence classes. Points are considered equivalent if they are in the same orbit of W relative to their nearest sublattice neighbors. A single point in each equivalence class can now be moved, and then the group used to extend this perturbation to the rest of the lattice. The specific perturbations that optimize the system can be found through a numerical optimization. Advantageously, this manner of perturbing the lattice retains the structure of the encoding system and allows the perturbation to be described using a small amount of information.

It should be noted that, for maintaining the desired encoding complexity, it is important that the points of $\Lambda'$ have not been perturbed, i.e., that they are still in the form of a lattice. Regardless of the sublattice index and perturbations of $\Lambda \backslash \Lambda'$, the first step in the encoding process can be to find the nearest point in the coarse lattice $\Lambda'$; the lattice structure makes this easy. Then, points forming a small subset of A are candidates for minimizing a function $f(D_0, D_1, D_2)$. In this manner, points of $\Lambda'$ are representatives of elements of the so-called power set of $\Lambda$, i.e., the set of all subsets of $\Lambda$.

Figure 7:
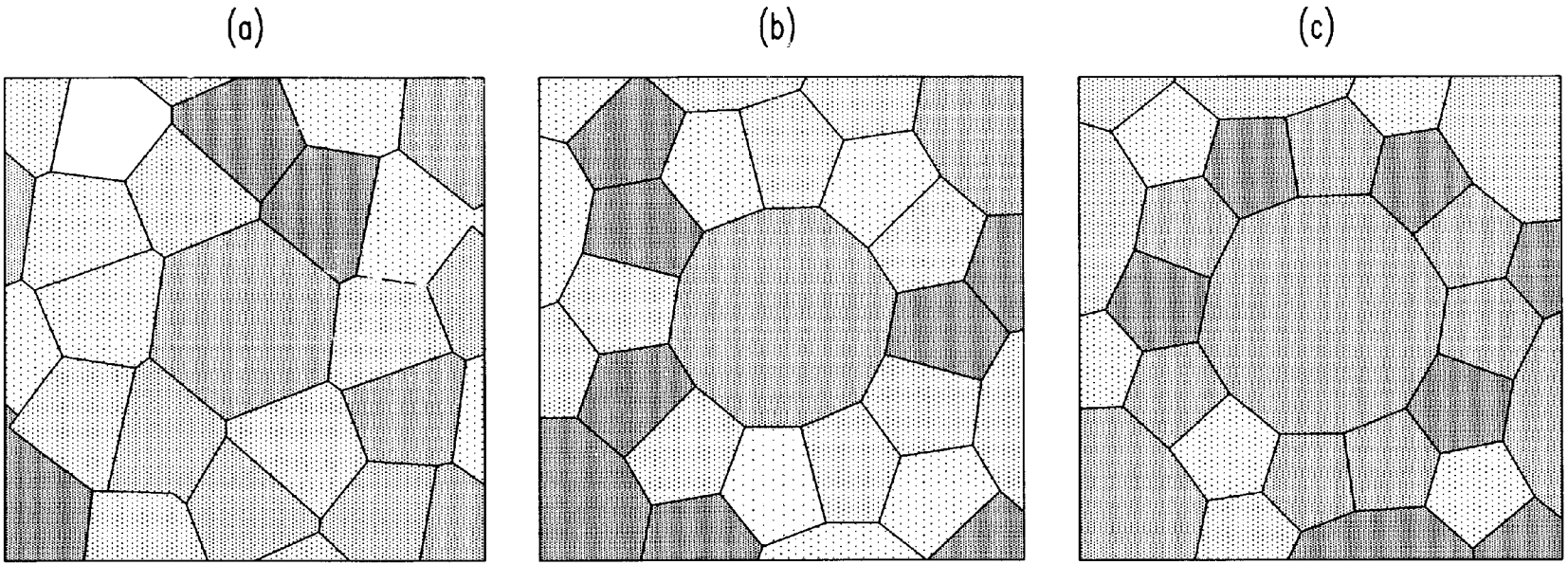
FIGS. 7(*a*), 7(*b*) and 7(*c*) show the shapes Voronoi cells with respect to multiple description distance for different loss parameters, after perturbation of the corresponding lattice in accordance with the invention.

Sample results of numerically optimized perturbations are shown in FIGS. 7(*a*) through 7(*c*). More specifically, FIGS. 7(*a*) through 7(*c*) show the shapes of Voronoi cells with respect to multiple description distance after permutation, for loss parameter values of p=0.1, 0.2 and 0.4, respectively. Note that the side cells are relatively circular in shape, as desired. The improvement with respect to AMSE is significant, peaking at about 0.18 dB.

The illustrative embodiments described above are based on two-description coding. Extensions of the LSMDVQ coding of the present invention to more than two descriptions will now be presented. As previously noted, the above-described conventional SVS algorithm relies heavily on the fact that there are exactly two channels, and thus a generalization to more than two descriptions is not readily apparent.

The present invention provides LSMDVQ techniques which use iterated sublattices, i.e., an ordered set of lattices such that each lattice is a sublattice of all lattices that precede it. For M descriptions, there are a total of M lattices $\Lambda_1 \subset \Lambda_2 \subset \ldots \subset \Lambda_M$. More generally, there may be an ordered set of M codebooks $\Lambda_1, \Lambda_2, \ldots, \Lambda_M$ of increasing size, with only the coarsest codebook necessarily corresponding to a lattice.

An important aspect of this construction of the illustrative embodiment of the present invention is a requirement that for each number of descriptions received k, there is a single decoding function that maps the received vector to $\Lambda_k$. This means that only M such decoding functions are required, instead of $2^M-1$ or one for each nonempty subset of M descriptions.

As a more general characterization of this construction, there may be, for each number $k \geqq 1$ of descriptions received, less than C(M, k) decoding functions that map the received vector to a codebook $\Lambda_k$, where C(M, k) denotes an "M choose k" operation, such that reconstruction of an encoded signal requires less than $2^M-1$ such decoding functions.

Figure 8:
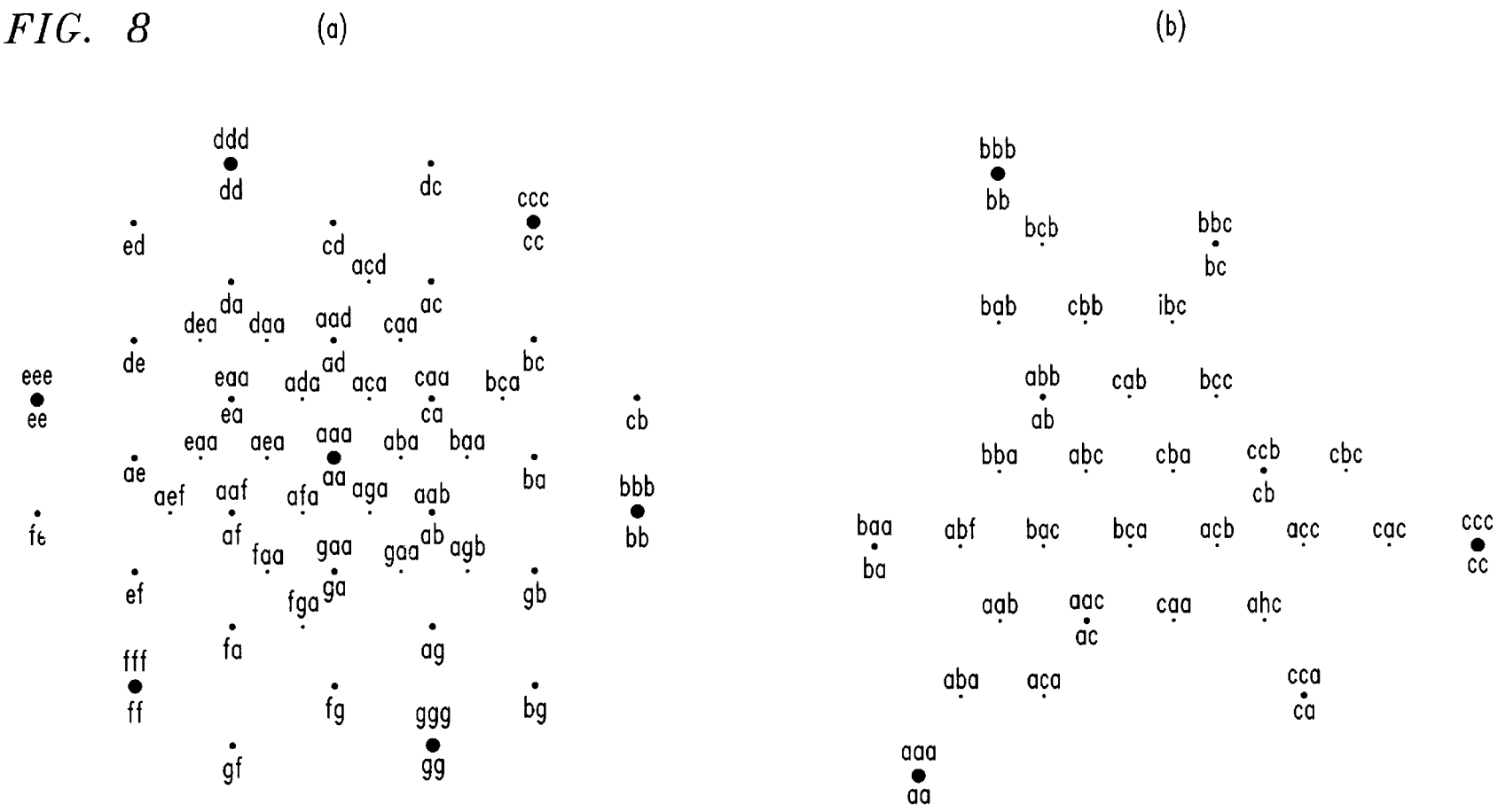
FIGS. 8(*a*) and 8(*b*) show examples of index assignments for three-description coding in accordance with the present invention.

FIGS. 8(*a*) and 8(*b*) show examples of index assignments for three-description LSMDVQ coding in accordance with the present invention. These examples are again based on the two-dimensional hexagonal lattice previously described. Triplet labels apply to the finest lattice $\Lambda_3$ and are actually transmitted. Doublet labels apply to the middle lattice $\Lambda_2$ and are used for reconstructing from two descriptions. The reconstruction labels for one description are omitted because they are clear from FIG. 4(*b*). Advantageously, these example index assignments allow a single decoder mapping for one received description and a single decoder mapping for two received descriptions.

The FIG. 8(*a*) example will now be described in more detail. In this example, the sublattice indices are $|\Lambda_3/\Lambda_2|=3$ and $|\Lambda_2/\Lambda_1|=7$. Suppose the source vector in this example lies close to the point labeled aba in the Voronoi cell of that point in $\Lambda_3$. The labeling is unique, so if all three descriptions are received, the source will be reconstructed to the resolution of $\Lambda_3$. Deleting one description leaves ba, aa, or ab. Note that the ordering of the two received labels has been preserved. These are nearby points on $\Lambda_2$, so the distortion is only a little worse than the resolution of $\Lambda_2$. Finally, if one description is received, the reconstruction is the nearest point of $\Lambda_1$ (point a) two-thirds of the time and the second-nearest point of $\Lambda_1$ (point b) one-third of the time. Other points are processed in a similar manner. The worst-case reconstructions are, from one description, the second closest point of $\Lambda_1$ (including ties), and for two descriptions, the fourth closest point of $\Lambda_2$. The example of FIG. 8(*b*) is similarly designed to provide good performance. The sublattice indices used in this example are higher, i.e., $|\Lambda_3/\Lambda_2|=7$ and $|\Lambda_2/\Lambda_1|=7$, so the redundancy is lower.

All of the techniques described previously for LSMDVQ encoding and decoding can also be applied to systems with more than two descriptions. Advantageously, the encoding and decoding operations retain their desirable computational complexity properties.

It should be noted that, although illustrated herein using lattices, the present invention can be more generally applied to ordered sets of codebooks, e.g., an ordered set of codebooks of increasing size in which only the coarsest of the codebooks corresponds to a lattice. The term "codebook" as used herein is therefore intended to include lattices as well as other arrangements of data points suitable for use in encoding and decoding operations.

The above-described embodiments of the invention are intended to be illustrative only. Alternative embodiments of the invention may utilize other coding structures and arrangements. The techniques of the invention are applicable to any desired types of base lattice and sublattice(s). Moreover, the invention may be used for a wide variety of different types of compressed and uncompressed input signals, and in numerous coding applications other than those described herein. These and numerous other alternative embodiments within the scope of the following claims will be apparent to those skilled in the art.

What is claimed s:

1. A method of encoding a signal for transmission, comprising the steps of:

encoding the signal in a lattice-structured multiple description vector quantization encoder which generates M descriptions of the signal, each of the descriptions being transmittable over a corresponding one of M channels, wherein the encoder is configured to minimize a distortion measure which is in the form of a function of: (i) a central distortion corresponding to reconstruction of the signal from all of the M descriptions, and (ii) at least one side distortion corresponding to reconstruction of the signal from a subset of the M descriptions; and transmitting the M descriptions over the M channels.

2. The method of claim 1 wherein the encoder selects a codebook element to minimize the distortion measure as a function of a loss parameter.

3. The method of claim 2 wherein the loss parameter corresponds to a probability of loss of at least a subset of the descriptions.

4. The method of claim 1 wherein M=2 and the distortion measure is in the form of a function $f(D_0, D_1, D_2)$, where $D_0$ is a central distortion resulting from reconstruction based on receipt of both a first and a second description, and $D_1$ and $D_2$ are side distortions resulting from reconstruction using only a first description and a second description, respectively, and $f(D_0, D_1, D_2)$ is not independent of $D_1$ and $D_2$.

5. The method of claim 1 wherein M is greater than two, and the encoder utilizes an ordered set of M codebooks $\Lambda_1, \Lambda_2, \ldots, \Lambda_M$ of increasing size, wherein the codebook $\Lambda_1$ corresponds to a lattice.

6. The method of claim 5 wherein for each number $k \geqq 1$ of descriptions received, there are less than C(M, k) decoding functions that map a received vector to a codebook $\Lambda_k$, such that reconstruction of the signal requires less than $2^M-1$ such decoding functions.

7. The method of claim 1 wherein the encoder is configured to encode at least a portion of the signal by first determining a nearest point in a coarse lattice.

8. The method of claim 7 wherein points in the coarse lattice identify subsets of finer resolution codebooks.

9. A method of encoding a signal for transmission, comprising the steps of:

encoding the signal in a lattice-structured multiple description vector quantization encoder which generates M descriptions of the signal, each of the descriptions being transmittable over a corresponding one of M channels, wherein the encoder is configured based at least in part on a distortion measure which is in the form of a function of: (i) a central distortion corresponding to reconstruction of the signal from all of the M descriptions, and (ii) at least one side distortion corresponding to reconstruction of the signal from a subset of the M descriptions; and transmitting the M descriptions over the M channels;

wherein M=2 and the distortion measure is in the form of a functions $f(D_0, D_1, D_2)$, where $D_0$ is a central distortion resulting from reconstruction based on receipt of both a first and a second description, and $D_1$ and $D_2$ are side distortions resulting from reconstruction using only a first description and a second description, respectively, and $f(D_0, D_1, D_2)$ is not independent of $D_1$ and $D_2$; and wherein the distortion measure comprises an average of mean-squared error (AMSE) distortion given by:

$$AMSE = \frac{1-\rho}{1+\rho}D_0 + \frac{\rho}{1+\rho}(D_1 + D_2),$$

where ρ is the probability that a given one of the descriptions will be lost.

10. A method of encoding a signal for transmission, comprising the steps of:

encoding the signal in a lattice-structured multiple description vector quantization encoder which generates M descriptions of the signal, each of the descriptions being transmittable over a corresponding one of M channels, wherein the encoder is configured based at least in part on a distortion measure which is in the form of a function of: (i) a central distortion corresponding to reconstruction of the signal from all of the M descriptions, and (ii) at least one side distortion corresponding to reconstruction of the signal from a subset of the M descriptions; and transmitting the M descriptions over the M channels;

wherein for an element $a \epsilon$ a lattice Λ and $l(a)=(x, y)$, where $x, y \epsilon$ a sublattice Λ', $\pi_1(a)=x$ and $\pi_2(a)=y$, a multiple description distance between x and a at a loss parameter p is given by:

$$d_p(x, a) = \sqrt{\frac{1-p}{1+p}\|x-a\|^2 + \frac{p}{1+p}(\|x-\pi_1(a)\|^2 + \|x-\pi_2(a)\|^2)}\ .$$

11. The method of claim 10 wherein the encoder utilizes a Voronoi cell with respect to the multiple description distance of the element $a \epsilon \Lambda$ with loss parameter p, wherein the Voronoi cell is given by:

$$V_p(a)=\{x \epsilon \mathbb{R}^n : d_p(x, a) \leqq d_p(x, b), \forall b \epsilon \Lambda\}.$$

12. A method of encoding a signal for transmission, comprising the steps of:

encoding the signal in a lattice-structured multiple description vector quantization encoder which generates M descriptions of the signal, each of the descriptions being transmittable over a corresponding one of M channels, wherein the encoder is configured based at least in part on a distortion measure which is in the form of a function of: (i) a central distortion corresponding to reconstruction of the signal from all of the M descriptions, and (ii) at least one side distortion corresponding to reconstruction of the signal from a subset of the M descriptions; and transmitting the M descriptions over the M channels;

wherein the encoder utilizes a lattice comprising a plurality of lattice points in which the locations of the lattice points other than the points in at least one designated sublattice have been perturbed relative to a regular lattice structure based at least in part on a grouping of points into equivalence classes, with the position of a subset of the points in a given class being adjusted as part of the lattice perturbation.

13. An apparatus for encoding a signal for transmission, comprising:

a lattice-structured multiple description vector quantization encoder which generates M descriptions of the signal, each of the descriptions being transmittable over a corresponding one of M channels, wherein the encoder is configured to minimize a distortion measure which is in the form of a function of: (i) a central distortion corresponding to reconstruction of the signal from all of the M descriptions, and (ii) at least one side distortion corresponding to reconstruction of the signal from a subset of the M descriptions.

14. A method of decoding a signal received over a communication medium, comprising the steps of:

receiving at least a subset of M descriptions of the signal over corresponding ones of M channels; and decoding the at least a subset of the M descriptions in a lattice-structured multiple description vector quantization decoder which is configured to minimize a distortion measure which is in the form of a function of: (i) a central distortion corresponding to reconstruction of the signal from all of the M descriptions, and (ii) at least one side distortion corresponding to reconstruction of the signal from a subset of the M descriptions.

15. An apparatus for decoding a signal received over a communication medium, comprising:

a lattice-structured multiple description vector quantization decoder for receiving at least a subset of M descriptions of the signal over corresponding ones of M channels, the decoder being operative to decode the at least a subset of the M descriptions to minimize a distortion measure which is in the form of a function of: (i) a central distortion corresponding to reconstruction of the signal from all of the M descriptions, and (ii) at least one side distortion corresponding to reconstruction of the signal from a subset of the M descriptions.

* * * * *